United States Patent [19]

Strömberg

[11] Patent Number: 4,590,728

[45] Date of Patent: May 27, 1986

[54] SYSTEM FOR SUPPORTING AN EXTERNAL CORRUGATED ROOFING PANEL ON AN INSULATED ROOF STRUCTURE

[75] Inventor: Jan Strömberg, Luleå , Sweden

[73] Assignee: Plannja AB, Luleå , Sweden

[21] Appl. No.: 662,409

[22] PCT Filed: Feb. 8, 1984

[86] PCT No.: PCT/SE84/00040

§ 371 Date: Oct. 3, 1984

§ 102(e) Date: Oct. 3, 1984

[87] PCT Pub. No.: WO84/03118

PCT Pub. Date: Aug. 16, 1984

[30] Foreign Application Priority Data

Feb. 10, 1983 [SE] Sweden ..... 8300717

[51] Int. Cl.[4] ..... E04B 5/00

[52] U.S. Cl. ..... 52/410; 52/478; 52/573

[58] Field of Search ..... 52/409, 410, 506, 573, 52/478

[56] References Cited

U.S. PATENT DOCUMENTS

| | | | |
|---|---|---|---|
| 3,031,044 | 4/1962 | Stitf et al. | 52/410 X |
| 3,038,573 | 6/1962 | Nuernberger . | |
| 4,250,678 | 2/1981 | Skuran . | |
| 4,348,846 | 9/1982 | Bellem . | |
| 4,516,371 | 5/1985 | Simpson | 52/409 X |

FOREIGN PATENT DOCUMENTS

| | | |
|---|---|---|
| 2256584 | 5/1973 | Fed. Rep. of Germany . |
| 2313517 | 12/1976 | France . |
| 7707186-8 | 8/1980 | Sweden . |

*Primary Examiner*—Carl D. Friedman

*Attorney, Agent, or Firm*—Holman & Stern

[57] ABSTRACT

A system for supporting a pre-shaped thin-walled external roofing (7) on a layer (4) of medium-hard insulation supported on an underlying carrying roof structure (1), which system has the form of a strip, characterized in that the strip comprises a plurality of groove-shaped portions (5*a*) interconnected by crest-shaped portions (5*b*), securing members (6) extending through the bottom of the groove-shaped portions (5*a*) and connected to the carrying roof structure (1). The external roofing (7) is connected to the crest-shaped portions (5*b*) of the system by fastening members (11).

14 Claims, 2 Drawing Figures

5a
6
6a
5b
5
6b
10
8b
8a
7b
9
11
7a
II
7
4
2
3
1

SYSTEM FOR SUPPORTING AN EXTERNAL CORRUGATED ROOFING PANEL ON AN INSULATED ROOF STRUCTURE

CROSS REFERENCE TO RELATED APPLICATION

This U.S. application stems from PCT International Application No. PCT/SE84/00040 filed Feb. 8, 1984.

BACKGROUND OF THE INVENTION

1. Field of the Invention

This invention relates to a system intended for securing a pre-shaped thin-walled external roofing, supported on a layer of medium-hard insulation, on an underlying carrying roof structure supporting the insulation layer, which system has the form of a strip.

2. Description of the Prior Art

Roof structures using soft and, respectively, hard insulation are previously known.

When soft insulation is used, battens of some kind are provided on the same support (usually sectional sheets), which carries the insulation. These battens are secured on the support and carry the external roofing, which normally consists of sheet metal. The insulation proper, thus, in such a structure has no carrying function.

When hard insulation is used, it is laid on a support (sectional sheets) and thereafter secured on the support by special fastening members. These fastening members comprise a cone-shaped body and a self-tapping screw extending therefrom. Said cone-shaped body co-operates with the hard insulation while the self-tapping screw is caused to engage with the sectional sheet constituting the support. When hard insulation is used, the external roofing material usually is roofing felt, which is fixed with glue on the hard insulation.

The two aforesaid roof structures have certain economic disadvantages. The roof structure with soft insulation comprises special battens for supporting the roofing which, of course, renders the structure more expensive. As regards the roof structure with hard insulation, it is generally known that such insulation is more expensive than soft and medium-hard insulation.

BRIEF SUMMARY OF THE INVENTION

The present invention has the object to provide a system for securing the external roofing, by means of which system it is possible to use relatively cheap medium-hard insulation in a roof structure, in which the insulation itself supports the external roofing.

This object of the invention is realized, in that the system.

An embodiment of the invention will now be described in detail with reference to the accompanying drawing, in which FIG. 1 is a schematic cross-sectional view of an embodiment of a roof structure, to which the system according to the invention is; and FIG. 2 is a cross-sectional view taken along line II—II in FIG. 1.

DETAILED DESCRIPTION

Figures 1, 2:
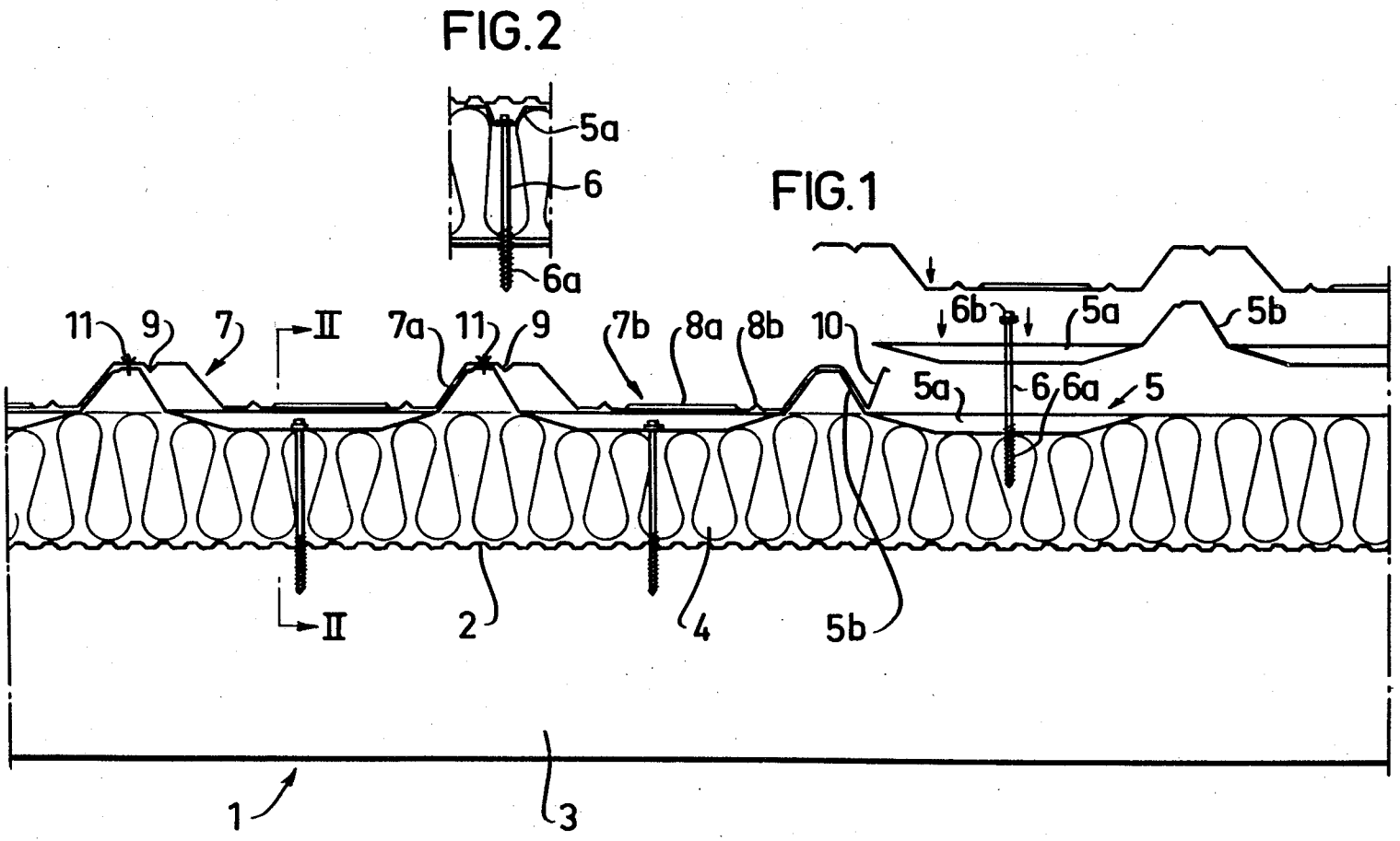

The roof shown in FIG. 1 comprises a carrying structure 1 at the lowermost part, which in the embodiment shown is a self-supporting sectional metal sheet with an embossed upper flange 2 and high webs 3.

The carrying roof structure extends between primary girders (not shown) with a spaced c/c-relationship of 6–12 m. The primary girders, thus, extend in the direction of the pitch.

As appears from FIG. 1, an insulation layer 4 is attached above the roof structure 1. The insulation usually is of so-called medium-hard type.

Above the insulation 4 a plurality of supporting strips 5 are arranged with a spaced relationship of 2–3 mm. The supporting strips 5 extend across the pitch direction.

The supporting strip 5 includes a portion 5*a* abutting the insulation. The cross-section of said portion appears from FIG. 2, i.e. said portion includes a central longitudinal groove recessed about 10–15 mm.

The grooved portions 5*a* are connected by a crest-shaped portion 5*b*, the configuration of which has space in the configuration of the external roofing and at least in some part joins to said portion.

As appears from FIG. 1, the supporting strips 5 are jointed in that two grooved portions 5*a* overlap one another.

The supporting strips 5 are secured in such a way, that screws 6 are passed through pre-drilled holes in the bottom of the grooved portion 5*a*, and a lower threaded portion 6*a* of the screw 6 is caused to engage with the upper flange 2 of the self-supporting sectional metal sheet. The screw 6 is threaded in to such a depth that the screw head 6*b* abuts the bottom of the grooved portions 5*a*.

By positioning the pre-drilled holes centrally in the grooved portions 5*a*, seen in the longitudinal direction of the strip, the holes are located directly above each other when the supporting strips are being jointed.

The supporting strips 5 are now secured against being lifted, but downward movement along the screws 6 can take place, because the pre-drilled holes have a diameter slightly exceeding that of the screw stem.

Above the supporting strips 5, the external roofing 7 in the form of a sectional metal sheet is attached. As appears from FIG. 1, the sectional sheet 7 comprises a plurality of crest portions 7*b*, which are connected by intermediate, substantially plane portions 7*b*, which are provided with embossments 8*a* and 8*b* extending both longitudinally and transversely. The crest portions 7*a* extend in the direction of the pitch and are provided with a longitudinal stiffening groove 9.

The sheet 7 has in one lateral edge a groove 10, which collects water possibly leaking in and drains it. The sheet is secured on the supporting strips 5 by fastening members 11, preferably screws, which extend through the highermost located portions of the sheet 7 and supporting strips 5.

When the external roofing is loaded by a downward directed force, for example snow load, the insulation 4 beneath the sheet 7 and supporting strip 5 is compressed. The supporting strip 5 thereby is moved downward along the screw 6, which is secured in the upper flange 2 and, thus, cannot be moved in its longitudinal direction. The maximum distance, through which the sheet 7 can be moved downward, corresponds to the depth of the grooved portion 5*a*. At further downward movement of the sheet 7, the screw head 6*b* will deform said sheet. However, the grooved portion 5*a* having a depth of about 15 mm, there is safe margin preventing the screw head 6*b* from contacting the portion 7*b* of the external roof sheet 7.

The use of medium-hard insulation also ensures limitation of the compression due to snow load.

At the embodiment shown, the carrying roof structure consists as stated above of sectional metal sheet with wide upper flange and high webs. It also can be imagined, however, to use a stiffened trapezoid sectional sheet as carrying structure. In order to avoid too high a load, at lifting forces, on the upper flange carrying the supporting strip, it is also imaginable within the scope of the invention to arrange the supporting strips so as to run diagonally over the trapezoid sectional sheet. This requires adaptation of the measures and angles of the strip.

It is also possible to use, for example, lightweight concrete elements as carrying roof structure.

As regards external roofing material, different types of roofing sheets can be used, but there must be agreement between the division of the sheets and supporting sheets.

At the embodiment described above, a special sectional metal sheet is used as external roofing material. There is no objection, however, to using corrugated sheets of other materials, for example plastic, glass fibre etc. as roofing material.

The invention, thus, is in no way restricted to the embodiment described above, but can freely be varied within the scope of the attached claims.

I claim:

1. A system for securing a pre-shaped thin walled external roofing on a layer of medium-hard insulation supported on an underlying supporting roof structure comprising:

a securing strip;

groove-shaped portions relatively spaced on said securing strip for contacting engagement with the insulation;

crest-shaped portions relatively spaced on said securing strip and connecting adjacent groove-shaped portions;

securing members extending through said groove-shaped portions for extending through the insulation to the underlying supporting roof structure;

means to facilitate movement of said securing strip relative to said securing members in the direction toward and away from the underlying supporting roof structure; and fastening members for securing the external roofing to said securing strip at said crest-shaped portions.

2. A system as claimed in claim 1 wherein:

said securing members comprise rod-shaped members; and said means to facilitate movement of said strip member relative to said securing member comprises pre-drilled holes in said groove-shaped portions having a diameter slightly larger than the diameter of the respective rod-shaped member at the portion thereof adjacent each hole.

3. A system as claimed in claim 2 wherein:

each groove-shaped portion has a groove depth in the region of a respective rod-shaped member sufficient to prevent contact of said rod-shaped members with said external roofing upon compression of the insulation due to said movement of said securing strip relative to said rod-shaped members caused by maximum load on the external roofing.

4. A system as claimed in claim 3 wherein:

said groove-shaped portions comprise grooves extending in one direction outwardly from one side of said securing strip;

said crest-shaped portions comprise ridges extending outwardly in the opposite direction from the other side of said securing strip; and said rod-shaped members comprise screws.

5. A system as claimed in claim 1 wherein:

each groove-shaped portion has a groove depth in the region of a respective securing member sufficient to prevent contact of said securing members with said external roofing upon compression of the insulation due to said movement of said securing strip relative to said securing members caused by maximum load on the external roofing.

6. A roof construction comprising:

a supporting roof structure;

a layer of medium-hard insulation supported on said supporting roof structure;

a plurality of supporting strips supported on said layer of insulation;

said supporting strips each comprising, a plurality of groove-shaped portions relatively spaced on said securing strip for contacting engagement with the insulation, and crest-shaped portions relatively spaced on said securing strip and connecting adjacent groove-shaped portions;

securing members extending through said groove-shaped portions and said layer of insulation and secured to said underlying supporting roof structure;

means to facilitate movement of said securing strip relative to said securing members in the direction toward and away from said underlying supporting roof structure;

pre-shaped thin walled external roofing overlying and supported on said securing strips; and means to fasten said external roofing to said securing strips.

7. A roof construction as claimed in claim 6 wherein:

said securing members comprise rod-shaped members; and said means to facilitate movement of said securing strips relative to said securing members comprise pre-drilled holes in said groove-shaped portions having a diameter slightly larger than the diameter of a respective rod-shaped member at the portion thereof adjacent each hole.

8. A roof construction as claimed in claim 7 wherein:

at least part of said crest-shaped portions are in direct contacting engagement with said external roofing.

9. A roofing construction as claimed in claim 8 wherein:

said rod-shaped members comprise screws having heads abutting the bottom of said groove-shaped portions when in the normal uncompressed position of said securing strips.

10. A roof construction as claimed in claim 9 wherein:

each groove-shaped portion has a groove depth in the region of a respective securing member sufficient to prevent contact of said securing members with said external roofing upon compression of the insulation due to said movement of said securing strip relative to said securing members caused by maximum load on said external roofing.

11. A roofing construction as claimed in claim 7 wherein:

said rod-shaped members comprise screws having heads abutting the bottom of said groove-shaped portions when in the normal uncompressed position of said securing strips.

12. A roof construction as claimed in claim 6 wherein:

at least part of said crest-shaped portions are in direct contacting engagement with said external roofing.

13. A roof construction as claimed in claim 6 wherein:

each groove-shaped portion has a groove depth in the region of a respective securing member sufficient to prevent contact of said securing members with said external roofing upon compression of the insulation due to said movement of said securing strip relative to said securing members caused by maximum load on said external roofing.

14. A roof construction as claimed in claim 6 wherein:

said groove-shaped portions comprise grooves extending in one direction outwardly from one side of said securing strip;

said crest-shaped portions comprise ridges extending outwardly in the opposite direction from the other side of said securing strip; and said rod-shaped members comprise screws.

* * * * *